US005312001A

United States Patent [19]

Sorensen

[11] Patent Number: 5,312,001

[45] Date of Patent: May 17, 1994

[54] PAINT CHIP DISPLAY ASSEMBLY

[75] Inventor: Gerald R. Sorensen, Elgin, Ill.

[73] Assignee: NCM International, Inc., Arlington Heights, Ill.

[21] Appl. No.: 22,970

[22] Filed: Feb. 25, 1993

[51] Int. Cl.[5] ..... B42F 9/00

[52] U.S. Cl. ..... 211/50; 211/88; 40/649

[58] Field of Search ..... 211/50, 55, 88, 89; 40/649, 124.2, 611; 206/560

[56] References Cited

U.S. PATENT DOCUMENTS

| | | | |
|---|---|---|---|
| 1,348,382 | 8/1920 | Smith | 40/642 |
| 1,817,229 | 8/1931 | Borovicka | 40/642 |
| 1,880,099 | 9/1932 | Marsh | 40/156 |
| 1,895,938 | 1/1933 | Matschler | 40/156 |
| 2,110,475 | 3/1938 | Schabert | 40/642 X |
| 3,609,893 | 10/1971 | Routzahn et al. | 40/642 |
| 3,958,348 | 5/1976 | Sakamoto | 40/642 |
| 3,974,576 | 8/1976 | Quinn, III | 40/156 X |
| 4,003,470 | 1/1977 | Lagorio et al. | 211/503 |
| 4,041,631 | 8/1977 | Stevens | 40/124.2 |
| 4,679,339 | 7/1987 | Hetzer | 40/649 |
| 4,736,538 | 4/1988 | Pierce et al. | 40/156 X |
| 4,745,695 | 5/1988 | Hetzer | 40/611 X |

*Primary Examiner*—Blair M. Johnson

*Attorney, Agent, or Firm*—Wallenstein, Wagner & Hattis, Ltd.

[57] ABSTRACT

A display assembly for sequentially dispensing a plurality of card-like samples in an upright position is disclosed. The assembly comprises a planar back panel, a retaining member having a pivotable hinge and receiving member for engaging the retaining member to the back panel for maintaining the card-like samples in upright contact with the back panel.

13 Claims, 2 Drawing Sheets

PAINT CHIP DISPLAY ASSEMBLY

TECHNICAL FIELD

This invention relates to a display assembly and, more particularly, to a paint chip holder having a planar back panel with a retaining member having a pivotable hinge, the retaining member including a pair of arms which exert pressure against the paint chip samples holding them securely in an upright position in the display.

BACKGROUND AND PRIOR ART

Stores which sell house paint need a convenient way to display the paint's color for consumers without having to open cans. This is typically accomplished using samples, also known as paint chips, having a swatch or swatches of paint appearing on strips or cards of paper or plastic. In a typical display, a plurality of paint chips of like color or colors are held upright on edge in front-to-back relationship such that removal of the frontmost sample from the assembly exposes the next adjacent sample. The consumer is encouraged to remove these samples from their display assembly and take them home.

A problem can occur when the consumer removes paint chips from the display. As the number of samples decreases in the display, the remaining samples have a tendency to fall forward out of an upright position. As a result, the true colors of the samples are not adequately displayed because at even a slight forward angle, light may not be properly reflected off the paint chip sample. Consequently, the consumer may be misled as to the proper paint color.

The present invention solves this problem through the use of a paint chip holder having a retaining member with a pivotable hinge, the retaining member having a pair of arms which exert pressure against the samples, so that no matter how many paint chips samples are removed by the consumer, the remaining samples stay in an upright position. Other advantages of the present invention include that the holder is easily refillable, portable, easy to maintain and assemble, can be displayed as a plurality and retains the paint chips without interference with visibility of either the paint chips or of the display assembly overall.

SUMMARY OF THE INVENTION

The present invention provides a display assembly for holding a plurality of card-like samples in an upright position, the holder comprising a planar back panel and a retaining member having a pivotable hinge and receiving means for engaging the retaining member to the back panel for maintaining the card-like samples in upright contact with the back panel. In use, the paint chip samples are loaded into the display assembly, resting in the pocket structure formed by the retaininq member in contact with the back panel, while the retaining member exerts pressure against the samples, keeping them in an upright position. Other features and advantages will be apparent from the following specification taken in conjunction with the following drawings.

DETAILED DESCRIPTION

Figure 1:
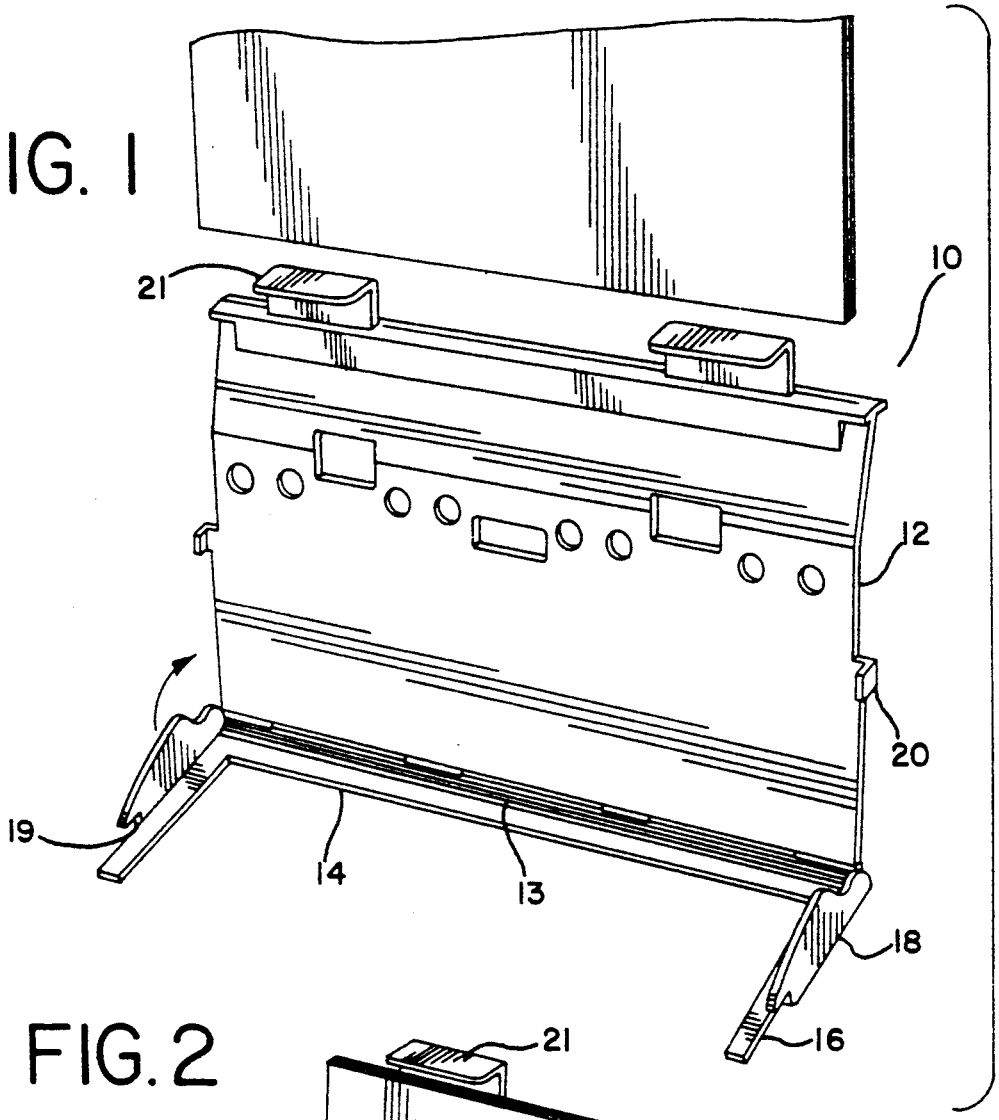
FIG. 1 is a perspective view of the paint chip holder showing the retaining member in an open position.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

This invention relates to a sample holder and more particularly, to a paint chip holder 10 for displaying paint chip samples to the consumer. The paint chip holder 10 comprises a planar back panel 12 and a retaining member 14 with a pivotable hinge 13, the retaining member 14 substantially coextensively engaged to one edge of the back panel 12. The retaining member 14 includes a pair of arms 16, each with a flange 18 having a notch 18*a*. The notched flanges 18 each engages a receiving means on each outer side edge of the back panel 12 to secure the retaining member 14 in an upright position, so that the retaining member 14 forms a pocket structure with the back panel 12. When a paint chip sample is placed in the holder 10, the arms 16 of the retaining member 14 exert pressure against the samples, holding them in an upright position for proper viewing by the consumer, regardless of how many samples are in the holder 10.

Figure 3:
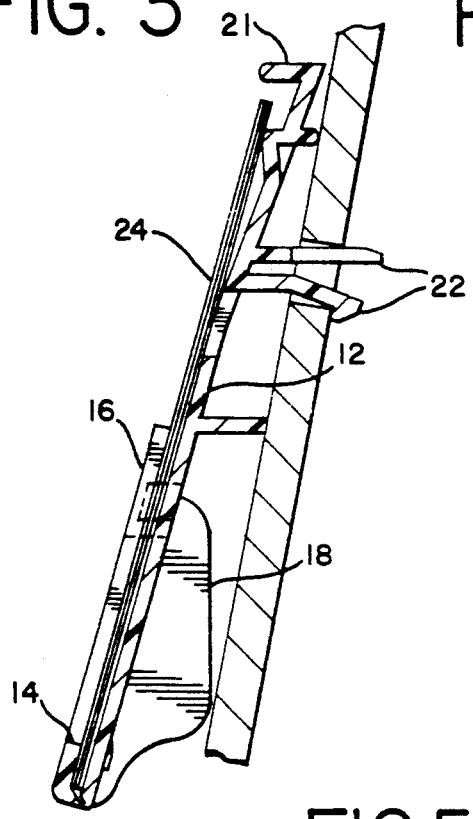
FIG. 3 is similar to FIG. 2 except that it is a side view of the paint chip holder.
Figure 4:
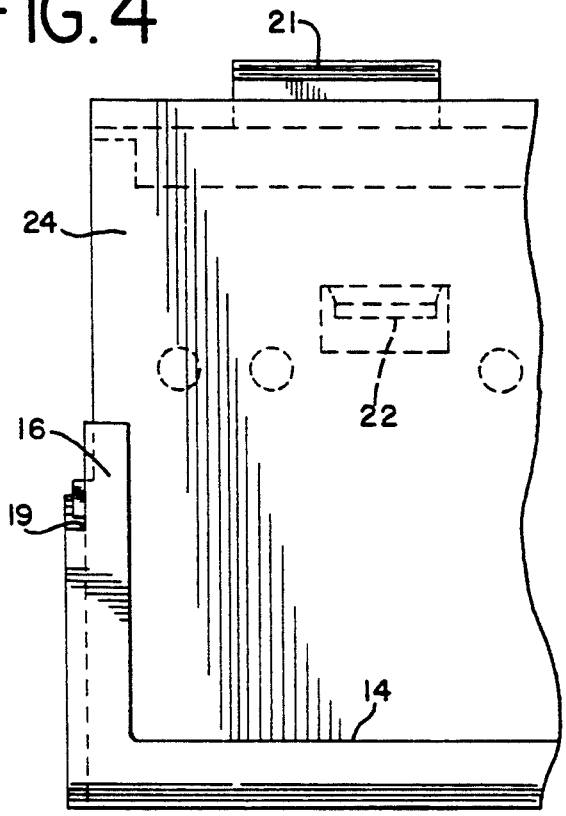
FIG. 4 is a sectional view of the front of the paint chip holder.
Figure 6:
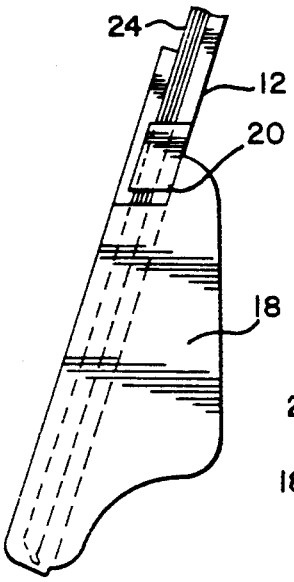
FIG. 6 is a side view of the retaining member in its upright position showing the flange secured to the back panel.
Figure 5:
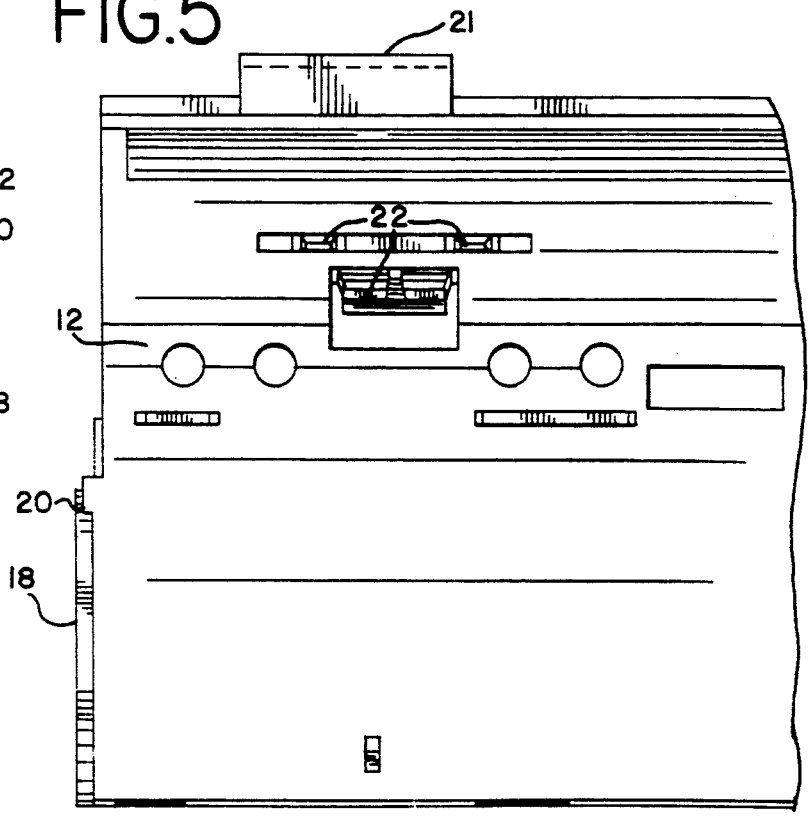
FIG. 5 is a sectional view of the reverse side of the chip holder showing the mounting bracket for attaching the holder to a display panel.

The planar back panel 12, preferably has a rectangular shape to sufficiently accommodate index-card shaped paint chip samples as illustrated in FIG. 3. The rear side of the back panel 12 is provided with two sets of finger-like projections 22 which enable the holder 10 to be mounted singularly or as a plurality in a suitable viewing position on a store display. The top edge of the back panel 12 includes a pair of retaining tabs 21 which keep the last paint chip sample from being removed from the display so that refilling the display with the correct color is easier for store personnel. The back panel 12 is preferably molded from any suitable plastic resin including polystyrene and polyethylene. More preferably, the back panel 12 is injection molded as one piece using polypropylene for strength and flexibility.

Figure 2:
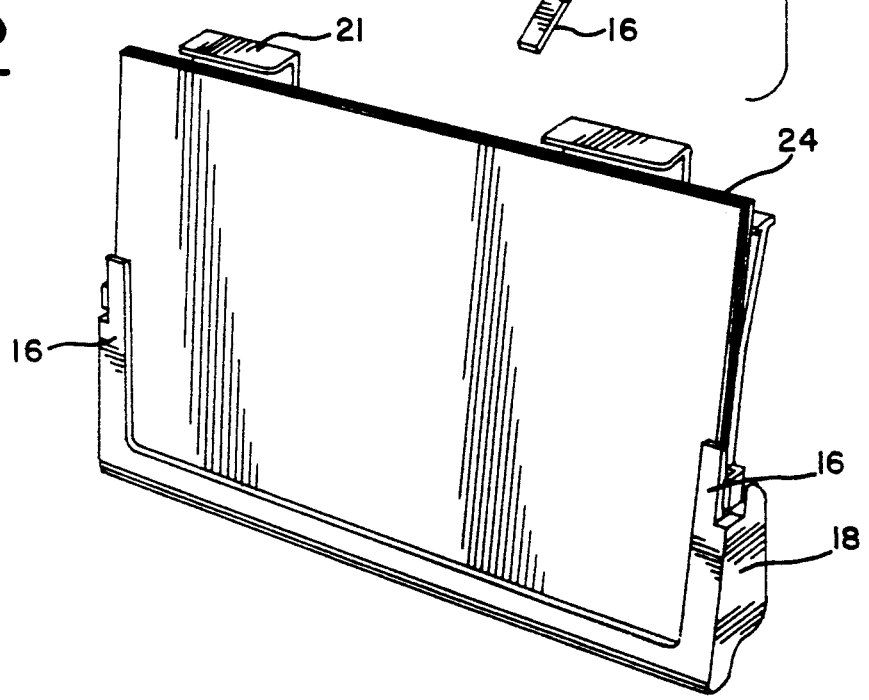
FIG. 2 is a perspective view of the paint chip holder showing the retaining member in an upright position and several paint chip samples placed therein.

The pivotable hinge 13, commonly referred to as a living hinge, allows the retaining member 14 to move freely about the edge of the back panel 12. The retaining member 12 includes a pair of arms 16, with one arm attached perpendicularly on each end of the retaining member 12 as illustrated in FIGS. 1 and 2. On the outer edge of each arm 16, a flange 18 extends therefrom so that the arm 16 and the flange 18 form a right angle. Each flange 18 has a notch 18*a* on its distal end. When the retaining member 14 is pivoted about its hinge 13 into an upright position each notched flange 18 engages with a receiving means comprising a small L-shaped projection 20 disposed on each side of the back panel 12. In this position, the arms 16 of the retaining member 14 are locked into an upright contact with the back panel 12 and hold the paint chip samples in place by exerting pressure against the samples so that as samples are removed from the holder 10, the remaining samples are retained in an upright position. The retaining member 14 and its pivotable hinge 13 are molded from any suitable plastic resin including polystyrene and polyethylene, but preferably injection molded as one piece with the back panel 12 using polypropylene for strength and flexibility.

In the present invention, when the retaining member 14 is in an upright position and locked to the back panel 12 via the receiving means 20, a pocket structure is formed at the juncture between the two parts wherein the paint chip samples can be placed. However, while the samples rest in the pocket structure, they are actually held in an upright contact position with the back panel 12 by the pressure exerted by the arms 16 of the retaining member 14 secured to the back panel 12.

The holder of the present invention is useful for displaying a variety of samples including, but not limited to, baseball cards, recipe cards, consumer information cards, paint chip samples, fabric samples, and wallpaper samples.

It will be understood that the invention may be embodied in other specific forms without departure from the spirit or central characteristics thereof. The present examples and embodiments, therefore, are not to be considered in all respects as illustrative and not restrictive, and the invention is not to be limited to the details given herein.

I claim:

1. A display assembly adapted to hold a plurality of card-like items in a generally predetermined upright position for proper viewing and/or removal comprising:

a generally planar back panel, a retaining member connected to said back panel by a pivotal hinge means, said retaining member comprising a portion integral with said pivotal hinge means and a pair of arms having free ends and extending from a point adjacent opposite ends of said pivotal hinge portion, said pivotal hinge means and said arms being integral and being hingedly attached to an edge of said generally planar back panel, receiving means on said arms for connecting the retaining member to the back panel for maintaining the card-like items in said upright position.

2. A display assembly adapted to hold at lease one generally planar item to be displayed in a generally predetermined position for proper viewing comprising:

a back panel means pivotally connected to an opposing retaining means along respective lower edges thereof by an integral hinge means to form a pocket structure adapted to hold said item, said retaining means including a hinge means portion extending along said retaining means lower edge and angularly related arm means having a free end upstanding from said hinge means portion from at least one end thereof, said arm means having a connector means for releasably engaging said back panel means to position said retaining means in place whereby it is adapted to hold an item to be displayed in a generally predetermined position.

3. The display assembly of either one of claims 1 or 2 wherein the retaining member is substantially coextensively attached to one edge of the planar back panel.

4. The display assembly of either of claims 1 or 2, wherein the receiving means includes a small L-shaped projection on each of opposite outer edges of the planar back panel.

5. The display assembly of either one of claims 1 or 2, wherein a notched flange extends from said retaining member generally at a right angle to an outer edge of each arm.

6. The display assembly of claim 5, wherein the notched flange extending from each arm engages with the receiving means to lock the arms of the retaining member into an upright contact position with the planar back panel.

7. The display assembly of either one of claims 1 or 2, wherein a pocket structure is formed at a juncture between the planar back panel and the retaining member.

8. The display assembly of either one of claims 1 or 2, wherein the back panel is injection molded from polypropylene.

9. The display assembly of either one of claims 1 or 2, wherein the retaining member is injection molded from polypropylene.

10. The display assembly of either one of claims 1 or 2, wherein the retaining member is injection molded as one piece with the back panel.

11. A display panel according to either one of claims 1 or 2, wherein said back panel is provided with finger-like projection means which enable said assembly to be mounted singularly or plurality in a suitable position for proper viewing.

12. A display panel according to either one of claim 1 or 2, wherein said back panel has a top edge, a tab means extending outwardly from said back panel whereby removal of said item is hindered.

13. A display panel according to either one of claims 1 or 2, wherein said arms have a portion adapted to bear against said card-like means to hold at least portions of said card-like means in contact with said back panel.

* * * * *